US011384628B2

(12) United States Patent
Dorban et al.

(10) Patent No.: US 11,384,628 B2
(45) Date of Patent: Jul. 12, 2022

(54) OPEN HOLE DISPLACEMENT WITH SACRIFICIAL SCREEN

(71) Applicant: Schlumberger Technology Corporation, Sugar Land, TX (US)

(72) Inventors: Andrew Michael Dorban, Houston, TX (US); Arnaud Andre, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/252,131

(22) PCT Filed: Jun. 18, 2019

(86) PCT No.: PCT/US2019/037601

§ 371 (c)(1),
(2) Date: Dec. 14, 2020

(87) PCT Pub. No.: WO2019/246009

PCT Pub. Date: Dec. 26, 2019

(65) Prior Publication Data

US 2021/0254441 A1 Aug. 19, 2021

Related U.S. Application Data

(60) Provisional application No. 62/686,501, filed on Jun. 18, 2018.

(51) Int. Cl.
*E21B 43/12* (2006.01)
*E21B 33/12* (2006.01)
(Continued)

(52) U.S. Cl.
CPC ..... *E21B 43/12* (2013.01); *E21B 33/12* (2013.01); *E21B 34/14* (2013.01); *E21B 43/04* (2013.01);
(Continued)

(58) Field of Classification Search
CPC ..... E21B 43/12; E21B 33/12; E21B 34/14; E21B 43/04; E21B 43/08; E21B 37/00;
(Continued)

(56) References Cited

U.S. PATENT DOCUMENTS 4,519,451 A 5/1985 Gray et al.
9,194,217 B2 * 11/2015 Watson ..... E21B 43/14
(Continued)

FOREIGN PATENT DOCUMENTS

EP 2431564 A1 3/2012
EP 3130745 A2 2/2017
WO 2018052462 A1 3/2018

OTHER PUBLICATIONS

International Preliminary Report on Patentability of International Patent Application No. PCT/US2019/037601 dated Dec. 22, 2020, 6 pages.

(Continued)

*Primary Examiner* — Michael R Wills, III
(74) *Attorney, Agent, or Firm* — Matthew Goode

(57) ABSTRACT

A downhole completion system and methodology is provided for use in a well. The downhole completion comprises a packer and a plurality of flow control sand screens. Each flow control sand screen has an inflow control device (ICD). The downhole completion further comprises at least one lower sand screen positioned below the plurality of flow control sand screens. The at least one lower sand screen is configured without an ICD. A flow restrictor is disposed between the plurality of flow control sand screens and the at least one lower sand screen.

19 Claims, 6 Drawing Sheets

(51) Int. Cl.

| | |
|---|---|
| ***E21B 34/14*** | (2006.01) |
| ***E21B 43/04*** | (2006.01) |
| ***E21B 43/08*** | (2006.01) |
| ***E21B 37/00*** | (2006.01) |

(52) U.S. Cl.
CPC ..... *E21B 43/08* (2013.01); *E21B 37/00* (2013.01); *E21B 2200/04* (2020.05); *E21B 2200/05* (2020.05); *E21B 2200/06* (2020.05)

(58) Field of Classification Search
CPC ..... E21B 2200/04; E21B 2200/05; E21B 2200/06
See application file for complete search history.

(56) References Cited

U.S. PATENT DOCUMENTS

| | | | | |
|---|---|---|---|---|
| 9,322,248 | B2 | 4/2016 | Yeh et al. | |
| 10,145,219 | B2 * | 12/2018 | Bourgneuf | E21B 33/12 |
| 2008/0128129 | A1 | 6/2008 | Yeh et al. | |
| 2010/0163235 | A1 | 7/2010 | Mootoo et al. | |
| 2011/0067877 | A1 | 3/2011 | Peixoto | |
| 2011/0073308 | A1 * | 3/2011 | Assal | E21B 43/08 166/278 |
| 2012/0103606 | A1 | 5/2012 | van Petegem et al. | |
| 2013/0192848 | A1 * | 8/2013 | Patel | E21B 34/06 166/373 |
| 2016/0177668 | A1 | 6/2016 | Watson et al. | |
| 2018/0058190 | A1 * | 3/2018 | Dorban | E21B 47/007 |

OTHER PUBLICATIONS

International Search Report and Written Opinion issued in PCT/US2019/037601 dated Oct. 2, 2019 (10 pages).
Combined Search and Examination Report issued in GB1908703.0, dated Oct. 29, 2019 (7 pages).

* cited by examiner

OPEN HOLE DISPLACEMENT WITH SACRIFICIAL SCREEN

CROSS-REFERENCE TO RELATED APPLICATION

This application is based on and claims priority to U.S. Provisional Application Ser. No. 62/686,501, filed Jun. 18, 2018, which is incorporated herein by reference in its entirety.

BACKGROUND

In various well applications, a wellbore is drilled into a hydrocarbon bearing reservoir and an open hole completion is deployed. With open hole completions, the drilling fluid is displaced by completions fluid which is delivered downhole. There are several methodologies that can facilitate this process. Some of those methodologies are employed prior to setting the gravel pack packer while others are employed after setting the gravel pack packer.

With respect to methodologies occurring following setting of the packer, various approaches may be employed. For example, when a standard sand screen is used in a standard circulation, the fluid is moved through the screen wellbore/casing annulus until such point that it is energetically more favorable for the carrier fluid to pass through the screen jacket, base pipe perforations, and wash pipe/base pipe annulus before entering the wash pipe to return to the casing annulus and then to the surface. This is reversed for the reverse circulation. When using sand screens which incorporate inflow control devices, however, flow through the sand screens is greatly restricted. This leads to a situation where fluid distributes itself (in inflow or outflow) across the entire completion. Such distribution leads to an inefficient sweep of the open hole which can result in poor results from subsequent gravel packing operations.

SUMMARY

In general, a downhole completion system and methodology is provided for use in a well. The downhole completion comprises a packer and a plurality of flow control sand screens. Each flow control sand screen has an inflow control device (ICD). The downhole completion further comprises at least one lower sand screen positioned below the plurality of flow control sand screens. The at least one lower sand screen is configured without an ICD and may be used as a sacrificial screen. A flow restrictor is disposed between the plurality of flow control sand screens and the at least one lower sand screen.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
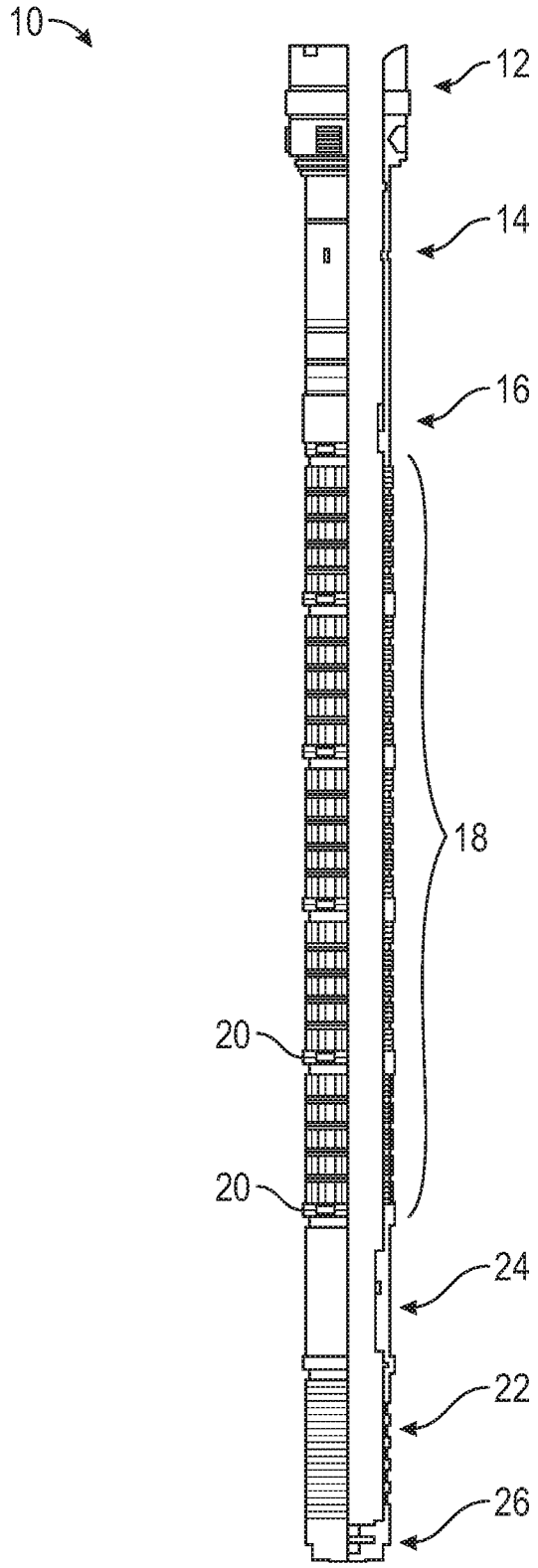
FIG. 1 is a partially cutaway illustration of an example of a completion system which may be deployed in an open hole borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate a fluid displacement process in which drilling fluid is displaced by completions fluid. According to an embodiment, a downhole completion system is provided for use in a well. The downhole completion comprises a packer and a plurality of flow control sand screens. Each flow control sand screen has an inflow control device (ICD). The downhole completion further comprises a lower sand screen positioned below the plurality of flow control sand screens. The lower sand screen is configured without an ICD and may serve as a sacrificial screen. One or more embodiments of the present disclosure may include one or more lower sand screens configured without an ICD positioned below the plurality of flow control sand screens. For example, there may be as many as two, three, or more lower sand screens configured without an ICD positioned below the plurality of flow control sand screens. A flow restrictor is disposed between the plurality of flow control sand screens and the at least one lower sand screen to enable selective sacrificing, e.g. isolation, of the at least one lower sand screen with respect to the flow control sand screens. That is, according to one or more embodiments of the present disclosure, using the flow restrictor to isolate the at least one lower sand screen effectively shuts off all flow to the at least one lower sand screen such that all flow is directed through the ICDs of the plurality of flow control sand screens. In some embodiments, other types of sand screens could be combined with the plurality of flow control sand screens located above the flow restrictor. Further, in some embodiments, one or more of flow control sand screens and/or lower sand screens may be a port instead of a sand screen. For example, the port may be configured with a housing and a sliding sleeve, where the port is able to be closed.

According to an embodiment, a downhole completion is deployed in a borehole, e.g. an open wellbore. The downhole completion comprises at least one flow control sand screen having, for example, an ICD, e.g. a plurality of sand screens with ICDs. The downhole completion also comprises a sand screen located below the at least one flow control sand screen. This lower sand screen does not contain a flow control device such as an ICD. The configuration of the downhole completion enables a fluid displacement process that facilitates open hole displacement of drilling fluid when the downhole completion includes a plurality of inflow (or outflow) restricted sand screens. The downhole completion may comprise a flow restrictor positioned between the flow control sand screens and the lower sand screen. The lower sand screen enables substantial flow, and the flow restrictor may be selectively actuated to sacrifice, e.g. separate, the lower sand screen to restrict flow from this high flow region.

Referring generally to FIG. 1, an example of a downhole completion 10 is illustrated. In this embodiment, the downhole completion 10 may be configured for use in an open hole borehole, e.g. an open hole wellbore. By way of example, the downhole completion may comprise a packer 12 which may be selectively set against a surrounding borehole wall. An extension 14 may be positioned between the packer 12 and a fluid loss control device 16, e.g. a flapper valve or other type of fluid loss control device.

Beneath the fluid loss control device 16, the downhole completion 10 includes at least one flow control sand screen 18. For example, the at least one flow control sand screen 18 may comprise a plurality of sequential flow control sand screens 18 which each have an ICD 20 or ICDs 20 (or other type of flow restriction device). The downhole completion 10 also includes a sand screen without flow restriction devices 24, e.g. without ICDs 20, to provide a high flow region between an exterior and an interior of the downhole completion 10.

As illustrated, a flow restrictor 24 may be positioned between the flow control sand screens 18 and the sand screen without flow restrictor 24 to enable selective sacrifice, e.g. isolation, of the sand screen without flow restrictor 24. The sand screen without flow restrictor 24 may be referred to as a lower sand screen 22, which means it is positioned farther downhole relative to the at least one flow control sand screen 18, e.g. the plurality of flow control sand screens 18. In some embodiments, the downhole completion 10 also comprises a washdown shoe 26, which may be located below the lower sand screen 22.

Figure 2:
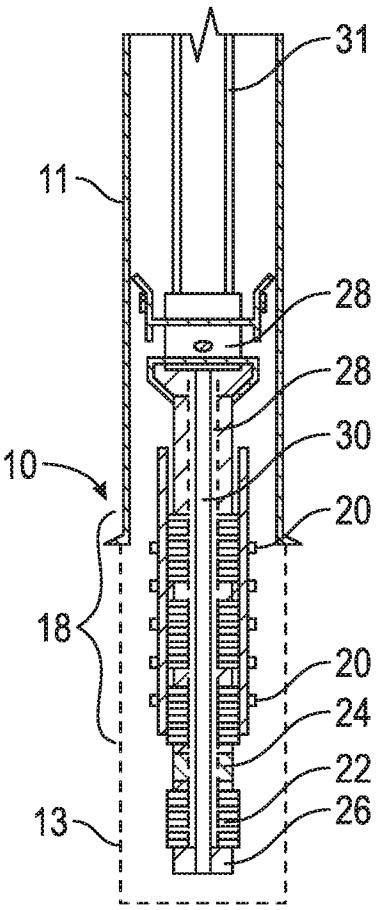
FIG. 2 is a schematic illustration of an example of a downhole completion constructed to facilitate a fluid displacement process and deployed in an open borehole, according to an embodiment of the disclosure.

According to an operational example, the downhole completion 10 is in the form of a bottom hole assembly, which may be run in a wellbore having a cased section 11 and a lower open hole section 13, as illustrated in FIG. 2. A service tool 28 may be simultaneously run with the downhole completion 10/bottom hole assembly or subsequently run. By way of example, the service tool 28 may comprise a service string tubing, e.g. washpipe 30, which extends down through an interior of the plurality of flow control sand screens 18, the flow restrictor 24, and the lower sand screen 22.

Figure 4:
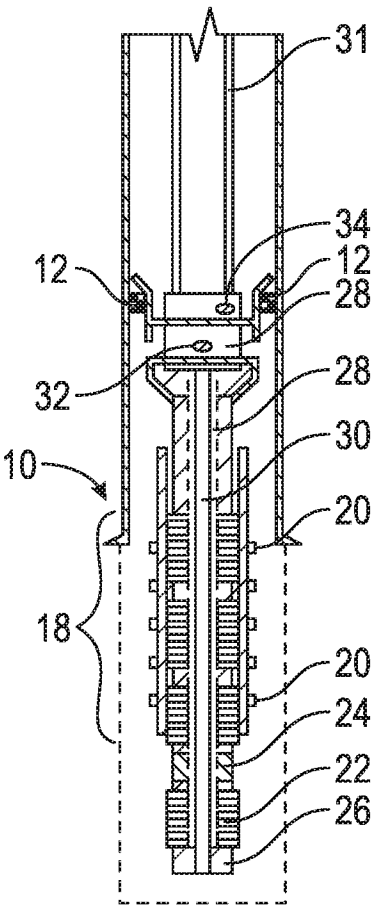
FIG. 4 is a schematic illustration similar to that of FIG. 3 but during a different operational stage, according to an embodiment of the disclosure.
Figure 3:
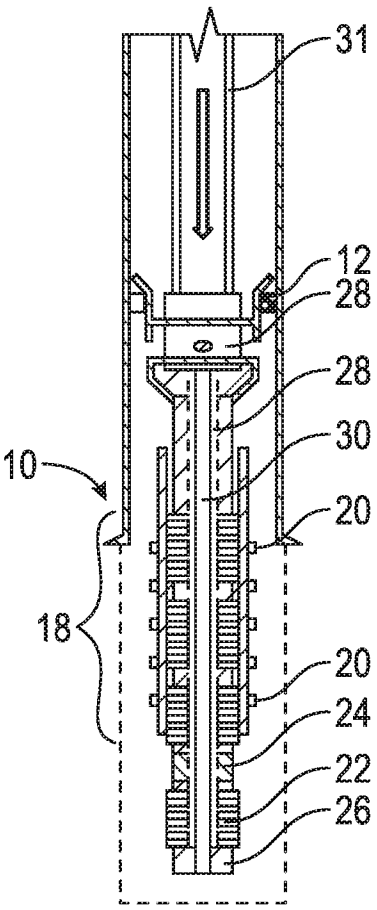
FIG. 3 is a schematic illustration similar to that of FIG. 2 but during a different operational stage, according to an embodiment of the disclosure.

As illustrated in FIG. 3, the packer 12 of the downhole completion 10 may be selectively set by applying a suitable tubing pressure as represented by the arrow illustrated within the work string tubing 31, e.g. drill pipe. Subsequently, the service tool 28 may be actuated, e.g. moved, to a circulating position. In this position, the service tool 28 positions a crossover port 32 in a gravel packing position and provides a service tool return port 34 above the packer, as illustrated in FIG. 4.

Figure 5:
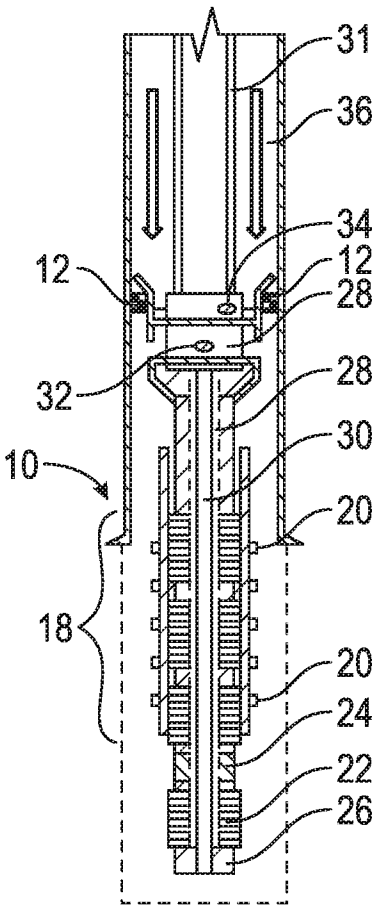
FIG. 5 is a schematic illustration similar to that of FIG. 4 but during a different operational stage, according to an embodiment of the disclosure.

At this stage, completions fluid may be introduced into an annulus 36 above the packer 12, as illustrated by the pair of arrows in FIG. 5. This stage effectively positions the completions fluid, e.g. fluid train that is to displace the drilling fluid, into the annular area around the top of the packer 12. It should be noted that in this embodiment, the fluid is illustrated as being pumped from the surface. In other embodiments, however, the fluid could be displaced by the service tool 28 through the gravel pack crossover port 32 before going to the circulating position illustrated in FIG. 4.

Figure 6:
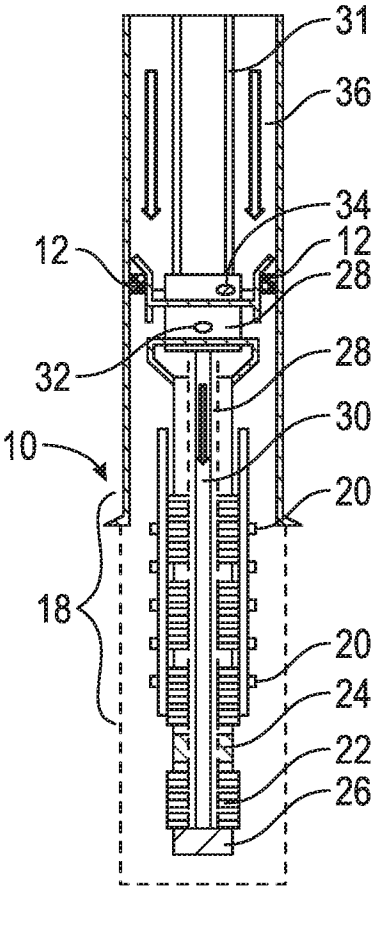
FIG. 6 is a schematic illustration similar to that of FIG. 5 but during a different operational stage, according to an embodiment of the disclosure.

As further illustrated in FIG. 6, the completions fluid may then be routed down through the service tool 28 and into the interior of the wash pipe 30. As the fluid pressure above the packer 12 increases, a flow path for displacement is created and the fluid enters the service tool return ports 34, passes through the service tool 28 (in the reverse direction to the gravel packing flow), and flows into the wash pipe 30 as illustrated by the arrows in FIG. 6. The fluid flow continues down through the wash pipe 30 and exits the wash pipe 30 into the annulus 36 between the wash pipe 30 and the base pipe of the lower sand screen 22.

Figure 8:
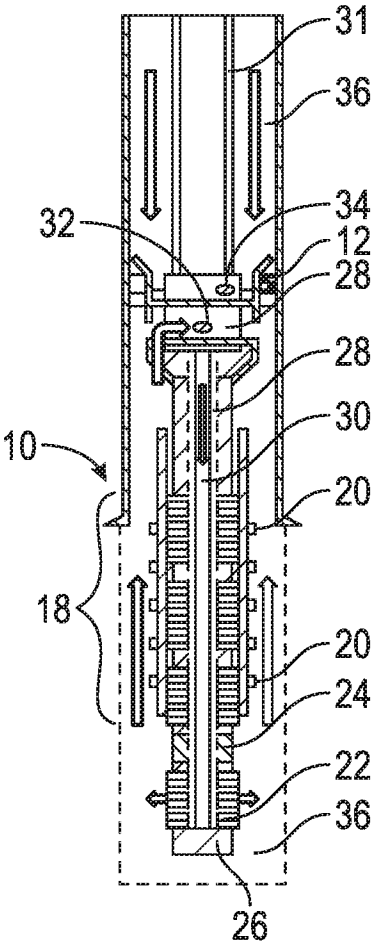
FIG. 8 is a schematic illustration similar to that of FIG. 7 but during a different operational stage, according to an embodiment of the disclosure.
Figure 7:
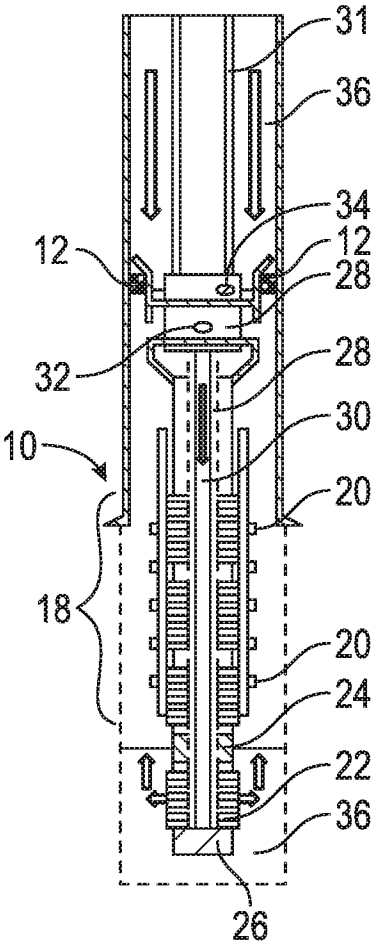
FIG. 7 is a schematic illustration similar to that of FIG. 6 but during a different operational stage, according to an embodiment of the disclosure.

This fluid continues to flow out through the free-flowing lower sand screen 22, as illustrated in FIG. 7. The lower sand screen 22 has many perforations, so the fluid is able to easily exit the sand screen 22 and flow into the surrounding open hole annulus 36, as illustrated by arrows in FIG. 7. The fluid then flows upwardly through this annulus 36 to continually displace the drilling fluid, as illustrated in FIG. 8. As the displacement continues, the fluid will sweep the open hole removing debris and drilling fluids.

Figure 9:
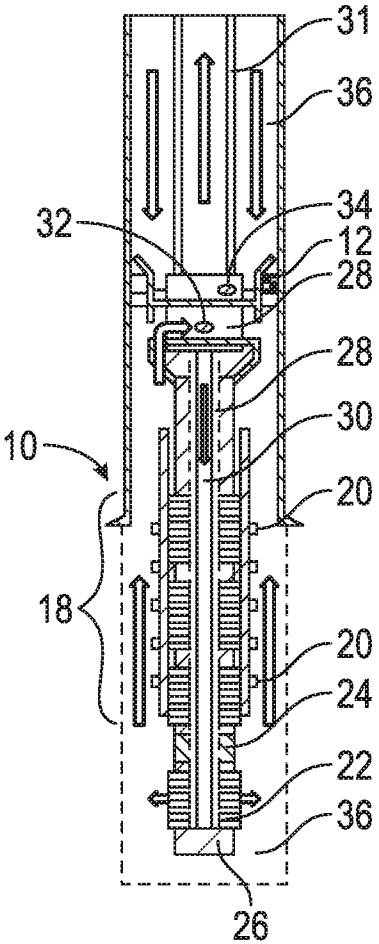
FIG. 9 is a schematic illustration similar to that of FIG. 8 but during a different operational stage, according to an embodiment of the disclosure.

The debris and drilling fluid will exit the system via the gravel packing crossover port 32 and then flow up through an interior of the work string 31 (drill pipe), as illustrated in FIG. 9. This displacement process is continued until a pre-determined amount of fluid has been displaced through the open hole so as to guarantee the system is clean and free of debris. Once this process is completed, the well can be gravel packed as per standard procedures or the service string can be removed. Removal of the service string also can be used to close the flow restrictor 24 and to thus sacrifice/isolate the lower sand screen 22 with respect to fluid flow therethrough.

Depending on the parameters of a given application, the flow restrictor 24 may have various configurations. For example, the flow restrictor 24 may comprise a flapper valve controlled by a sliding sleeve, a ball valve, a formation isolation valve, a plug, a single or series of sliding sleeves, or various other flow control devices which may be selectively actuated to restrict or block further inflow (or outflow) through the lower sand screen 22. It should be noted that in the embodiments illustrated, no polished bore receptacles are shown above the washdown shoe 26 or adjacent the flow restrictor 24. In other embodiments, however, polished bore receptacles could be included.

Figure 10:
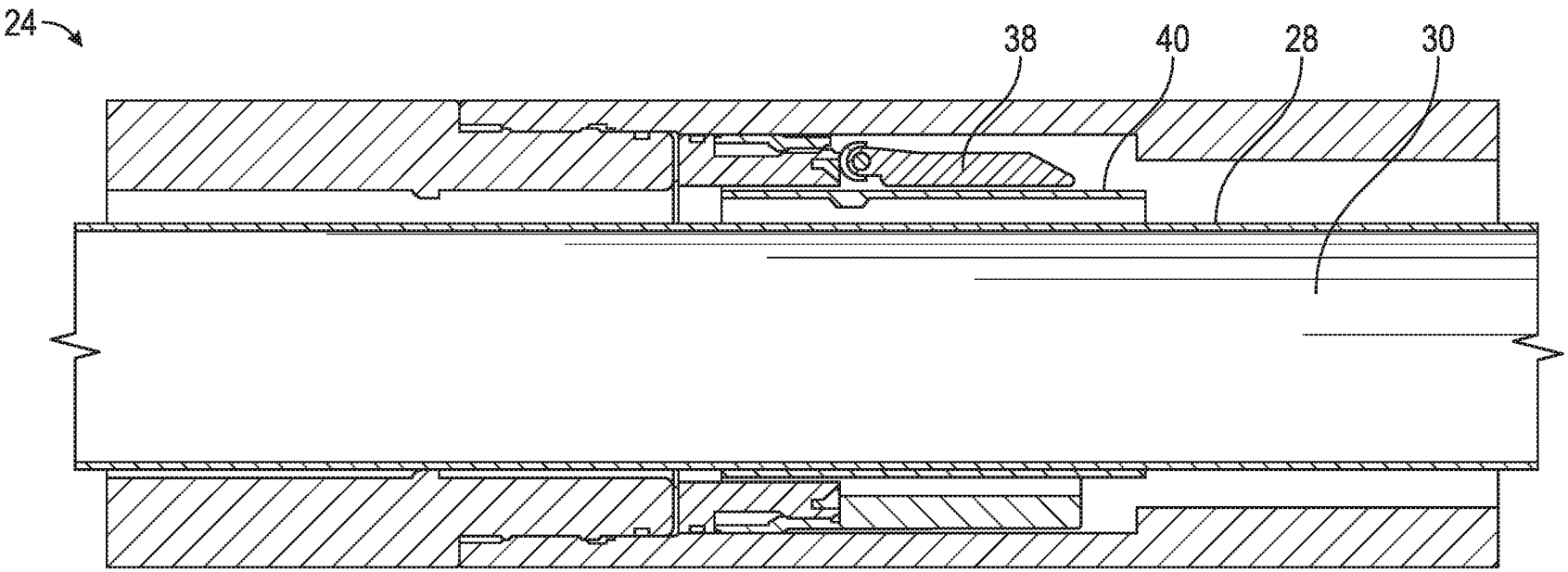
FIG. 10 is a cross-sectional illustration of an example of a flow restrictor which may be positioned between sand screens with and without an inflow control device (ICD), according to an embodiment of the disclosure.
Figure 11:
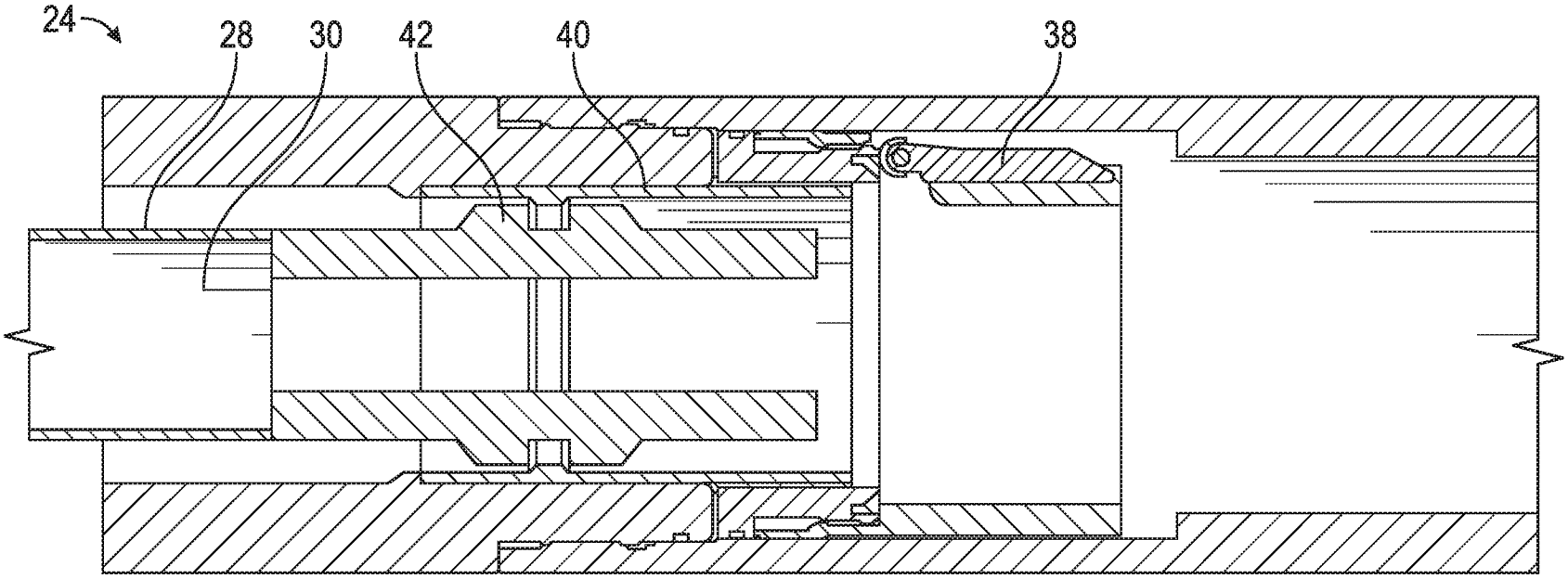
FIG. 11 is a schematic illustration similar to that of FIG. 10 but during a different operational stage, according to an embodiment of the disclosure.
Figure 12:
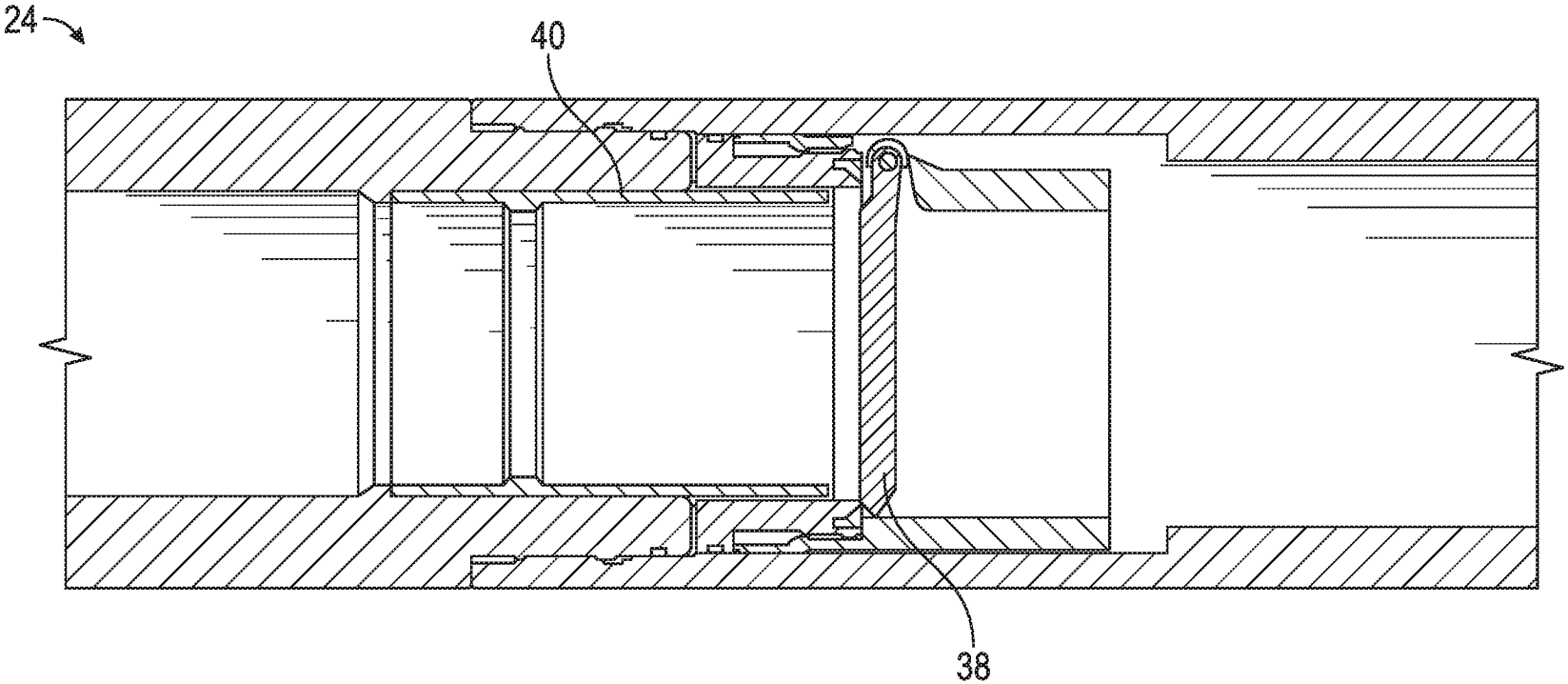
FIG. 12 is a schematic illustration similar to that of FIG. 10 but during a different operational stage, according to an embodiment of the disclosure.

Referring generally to FIGS. 10-12, an example of a flow restrictor 24 is illustrated and is of the type that may be used in the downhole completion 10 between the flow control sand screens 18 and the lower sand screen 22. The illustrated example effectively provides a modified flapper valve 38 that will close and seal in a flow direction but can be held open by a sleeve 40 to avoid interaction with downhole tools. In normal operations, for example, the flow restrictor 24 is held in an open position by a sleeve 40, as illustrated in FIG. 10, so that the normal operations are not impacted.

In FIG. 10, a tubing, e.g. a service tool string washpipe 30/tubing, is illustrated as extending through an interior of the sleeve 40 and an interior of the flow restrictor 24 as the flapper valve 38 is held in an open position via the sleeve 40. The service tool string 28 may comprise a shifting tool 42 which is used to shift the sleeve 40, as illustrated in FIG. 11. Once the sleeve 40 is shifted to the close position, the flapper valve 38 is able to close, thus restricting or blocking flow as illustrated in FIG. 12. By way of example, the shifting tool 42 may be positioned at a lower end of the service tool string 28 so that the sleeve 40 may be shifted and the flow restrictor 24 closed when the service tool string 28 is pulled out of hole.

In the specific example illustrated, the flow restrictor 24 is constructed to prevent inflow of fluid through the lower sand screen 22 but other embodiments may be constructed to restrict the inflow of fluid. In some embodiments, the flow restrictor 24 also may be located at other positions along the downhole completion 10, and it is not restricted to positions above the lowest sand screen 22 or even to positions in the lower completion.

Depending on the application, many types of flow restrictors 24 and shifting tools 42 may be used. Additionally, the flow control sand screens 18 may incorporate various types of inflow control devices 20 or other flow restriction devices. Each of the flow control sand screens 18 comprises some type of ICD 20 or other flow control device, but additional sand screens having other configurations also may be located above the flow restrictor 24. The sand screen 22 located below the flow restrictor 24 may be a single sand screen 24 or a plurality of sand screens 24 and also may have various configurations to facilitate a freer flow of fluid to facilitate the fluid displacement operation. Additionally, the size and configuration of various components, such as the packer 12, extension 14, fluid loss control device 16, flow control sand screens 18, lower sand screen 22, washdown shoe 26, and polished bore receptacle(s), may be adjusted according to the parameters of a given operation and environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a downhole completion having:

a packer;

a plurality of flow control sand screens, each flow control sand screen having an inflow control device (ICD);

at least one sand screen positioned below the plurality of flow control sand screens, the at least one sand screen being configured without an ICD; and a flow restrictor disposed between the plurality of flow control sand screens and the at least one sand screen; and a service tool string comprising a wash pipe, the service tool string coupled to the downhole completion such that the service tool, when deployed within the well, is deployed simultaneously with the downhole completion.

2. The system as recited in claim 1, wherein the flow restrictor comprises at least one selected from the group consisting of: a flapper valve controlled by a sliding sleeve; a ball valve; a formation isolation valve; and a plug.

3. The system as recited in claim 1, wherein the packer is disposed above the plurality of flow control sand screens.

4. The system as recited in claim 1, wherein the downhole completion further comprises a washdown shoe disposed below the at least one sand screen.

5. The system as recited in claim 4, wherein the downhole completion further comprises at least one polished bore receptacle above the washdown shoe.

6. The system as recited in claim 1, wherein the downhole completion further comprises a fluid loss control device positioned between the packer and the plurality of flow control sand screens.

7. The system as recited in claim 1, wherein the service tool string, when deployed within the well, is deployed down through the plurality of flow control sand screens and the at least one sand screen.

8. The system as recited in claim 1, wherein the service tool string comprises a shifting tool for operating the flow restrictor.

9. The system as recited in claim 1, wherein the flow restrictor disposed between the plurality of flow control sand screens and the at least one sand screen shuts off all flow to the at least one sand screen such that all flow is directed through the ICDs of the plurality of flow control sand screens.

10. A method, comprising:

deploying a downhole completion in a wellbore comprising a cased section and a lower open hole section, the downhole completion comprising:

a packer;

a plurality of flow control sand screens, each flow control sand screen having an inflow control device (ICD);

at least one sand screen positioned below the plurality of flow control sand screens, the at least one sand screen being configured without an ICD; and a flow restrictor disposed between the plurality of flow control sand screens and the at least one sand screen, the flow restrictor being in an open position;

running a service tool comprising a wash pipe downhole simultaneously with the downhole completion, the wash pipe extending down through an interior of the plurality of flow control sand screens, the flow restrictor, and the at least one sand screen;

setting the packer;

introducing completions fluid into an annulus of the cased section of the wellbore above the packer;

using the service tool to displace drilling fluid from the open hole section of the wellbore with the completions fluid;

routing the completions fluid down through the service tool, into an interior of the wash pipe, and out of the wash pipe and into an annulus of the open hole section via the at least one sand screen to continually displace the drilling fluid;

allowing the displaced drilling fluid to exit the downhole completion via the service tool and then flow up through an interior of a work string; and closing the flow restrictor to isolate the at least one sand screen such that subsequent flow is directed through the ICD of the plurality of flow control sand screens.

11. The method of claim 10, the method further comprising gravel packing the wellbore after the allowing step.

12. The method of claim 10, the method further comprising removing the service tool from the wellbore.

13. The method of claim 12, wherein removing the service tool from the wellbore closes the flow restrictor.

14. The method of claim 10, wherein the flow restrictor comprises at least one selected from the group consisting of: a flapper valve controlled by a sliding sleeve; a ball valve; a formation isolation valve; and a plug.

15. The method of claim 10, wherein the packer is disposed above the plurality of flow control sand screens.

16. The method of claim 10, wherein the downhole completion further comprises a washdown shoe disposed below the at least one sand screen.

17. The method of claim 10, wherein the downhole completion further comprises a fluid loss control device positioned between the packer and the plurality of flow control sand screens.

18. The method of claim 10, wherein the service tool comprises a shifting tool that facilitates closing of the flow restrictor.

19. The method of claim 18, wherein the flow restrictor comprises a flapper valve controlled by a sliding sleeve.

* * * * *